United States Patent [19]

Fendley et al.

[11] Patent Number: 4,866,334

[45] Date of Patent: Sep. 12, 1989

[54] CRT FACEPLATE FRONT ASSEMBLY WITH RIGIDIZED TENSION MASK SUPPORT STRUCTURE

[75] Inventors: James R. Fendley, Arlington Heights; Siegfried M. Greiner, Crystal Lake, both of Ill.

[73] Assignee: Zenith Electronics Corporation, Glenview, Ill.

[21] Appl. No.: 192,412

[22] Filed: May 10, 1988

[51] Int. Cl.[4] ..... H01J 29/07

[52] U.S. Cl. ..... 313/407; 313/408; 445/30; 445/37

[58] Field of Search ..... 313/402, 408, 407; 445/30, 37, 47

[56] References Cited

U.S. PATENT DOCUMENTS 3,894,321 7/1975 Moore ..... 313/402

4,695,761 9/1987 Fendley ..... 313/407

*Primary Examiner*—Kenneth Wieder

[57] ABSTRACT

A faceplate assembly for a color cathode ray tube includes a glass faceplate having on its inner surface a centrally disposed phosphor screen. A metal foil shadow mask is mounted in tension on a mask support structure located on opposed sides of the screen and secured to the inner surface of the faceplate. The support structure according to the invention has an open side facing the screen filled with a reinforcing material effective to render the structure mechanically rigid and prevent flexure of the structure toward the screen under the tension of the shadow mask. A process for manufacturing the inventive structure is also disclosed.

16 Claims, 3 Drawing Sheets

CRT FACEPLATE FRONT ASSEMBLY WITH RIGIDIZED TENSION MASK SUPPORT STRUCTURE

CROSS-REFERENCE TO RELATED APPLICATIONS AND PATENTS

This application is related to but in no way dependent upon copending applications Ser. No. 832,493 filed Feb. 1, 1986, now U.S. Pat. No. 4,701,678; Ser. No. 832,556 filed Feb. 21, 1986, now U.S. Pat. No. 4,695,761; Ser. No. 925,424 filed Oct. 31, 1986; Ser. No. 058,095 filed June 4, 1987; and Ser. No. 178,175 filed Apr. 6, 1988, all of common ownership herewith.

BACKGROUND OF THE INVENTION

Field of the Invention

This invention relates to color cathode ray picture tubes, and is addressed specifically to an improved front assembly for color tubes having shadow masks of the tension foil type in association with a substantially flat faceplate. The invention is useful in color tubes of various types, including those used in home entertainment television receivers, and in medium-resolution and high-resolution tubes intended for color monitors.

The use of the foil-type flat tension mask and flat faceplate provides many benefits in comparison to the conventional curved shadow mask and correlatively curved faceplate. Chief among these is a greater power-handling capability which makes possible as much as a three-fold increase in brightness. The conventional curved shadow mask, which is not under tension, tends to "dome" in picture areas of high brightness where the intensity of the electron beam bombardment is greatest. Color impurities result as the mask moves closer to the faceplate, and as the beam-passing apertures move out of registration with their associated phosphor elements on the faceplate. When heated, the tension mask distorts in a manner quite different from that of the conventional mask. If the entire mask is heated uniformly, there is no doming and no distortion until tension is completely lost; just before that point, wrinkling may occur in the corners. If only portions of the mask are heated, those portions expand, and the unheated portions contract, resulting in displacements within the plane of the mask; i.e., the mask remains flat.

The tension foil shadow mask is a part of the cathode ray tube front assembly, and is located in close adjacency to the faceplate. The front assembly comprises the faceplate with its screen with its deposits of light-emitting phosphors, a shadow mask, and support means for the mask. As used herein, the term "shadow mask" means an apertured metallic foil which may be, by way of example, about 0.001 inch thick, or less. The mask must be supported in high tension a predetermined distance from the inner surface of the cathode ray tube faceplate; this distance is known as the "Q-distance". As is well known in the art, the shadow mask acts as a color-selection electrode, or parallax barrier, which ensures that each of the three beams generated by the electron gun located in the neck of the tube lands only on its assigned phosphor deposits.

The requirements for a support means for a foil shadow masks mask are stringent. As has been noted, the foil shadow mask is normally mounted under high tension; e.g., 30 pounds per linear inch. In consequence, the support means must be of high strength so the mask is held immovable; an inward movement of the mask of as little as 0.0002 inch can cause the loss of guard band. Also, it is desirable that the shadow mask support means be of such configuration and material composition as to be compatible with the means to which it is attached. As an example, if the support means is attached to glass, such as the glass of the inner surface of the faceplate, the support means must have a coefficient of thermal contraction compatible with that of the glass, and by its composition, be bondable to glass. Also, the support means must be of such composition and structure that the mask can be secured to it by production-worthy techniques such as electrical resistance welding or laser welding. Further, it is essential that the support means provide a suitable surface for mounting and securing the mask. The material of which the support structure is composed must be adaptable to machining or to other forms of shaping so the structure can be contoured into near-perfect flatness. Otherwise, voids will exist between the metal of the mask and the support structure, preventing positive, uniform contact of the mask to the support structure necessary for proper mask securement.

Means for securing the shadow mask support to the inner surface of the faceplate may comprise a cement in the form of a solder glass, also known as "frit." While satisfactory in the main, cement of this type has a significant disadvantage in that it tends to create pockets in which screening fluids may lodge and be released later as contaminants. The cathodes of the electron gun are particularly susceptible to poisoning from contaminants. Also, deep-lying ones of such pockets in the devitrified solder glass may be connected to the surface of the solder glass by a tiny conduit. The air retained in the pocket may not be depleted during the exhaust cycle, but slowly leak out through the conduit after the tube is sealed, resulting in a reject as a "gassy" tube.

In U. S. Pat. No. 3,894,321 to Moore, of common ownership herewith, there is disclosed means for mounting a foil shadow mask on "rails" which extend from the faceplate. In another embodiment, the faceplate is shown as having an inner ledge that forms a continuous path around the tube, the top surface of which is a Q-distance away from the faceplate for receiving a foil mask.

In U.S. Pat. No. 4,695,761 to Fendley, of common ownership herewith, a hollow foil shadow mask support structure is disclosed in which the structure has a cross section in the form of an inverted "V," the narrow end of which provides for receiving the mask, and wherein the wide, open end is secured to the faceplate. The means of securement is by beads of glass frit. Other foil mask support structure embodiments are also disclosed, such as a hollow tube and a rectangle.

In referent application Ser. No. 942,336 of common ownership herewith, there is disclosed a support structure for a tensed foil shadow mask comprising an inverted channel member of metal with a stiffening core of a material such as ceramic secured within, and lateral to, the channel member. In one embodiment of the invention, the space between the stiffening core and the inner walls of the channel is filled with a devitrified glass frit. In another embodiment, a ceramic slurry is poured into a V-shaped support member and is allowed to set, with the object of stiffening the support structure. Except for the area of the structure that contacts the faceplate, the ceramic is totally enclosed within the support structure. A devitrified glass frit may be used as the stiffening material, similarly enclosed within the structure.

In application Ser. No. 178,175 to Capek et al, also of common ownership herewith, there is disclosed a support structure comprising a hollow shell filled with at least two devitrified solder glass compositions each having a different viscosity when in the form of an undevitrified solder glass paste. The object of the invention is to prevent the formation of the previously described air-filled pockets in the devitrified solder glass. The solder glass is completely enclosed within the support structure.

OBJECTS OF THE INVENTION

It is a general object of the invention to provide an improved faceplate assembly for a color cathode ray tube having a tensed foil shadow mask and a substantially flat faceplate.

It is an object of the invention to provide a faceplate assembly having improved means for mounting a tensed foil shadow mask.

It is another object of the invention to provide an improved support structure and process for mounting a tensed foil shadow mask in association with a substantially flat faceplate.

It is a further object of this invention to provide a process for use in the manufacture of tension mask faceplate assemblies that reduces manufacturing costs.

It is a yet another object of the invention to provide means and process for strengthening a support structure for a tensed foil shadow mask.

It is a specific object of this invention to provide a shadow mask support structure that is mechanically rigid, easy to manufacture, and which uses a minimum amount of costly alloy.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings (not to scale), in the several figures of which like reference numerals identify like elements, and in which:

DESCRIPTION OF THE PREFERRED EMBODIMENT

Figure 1:
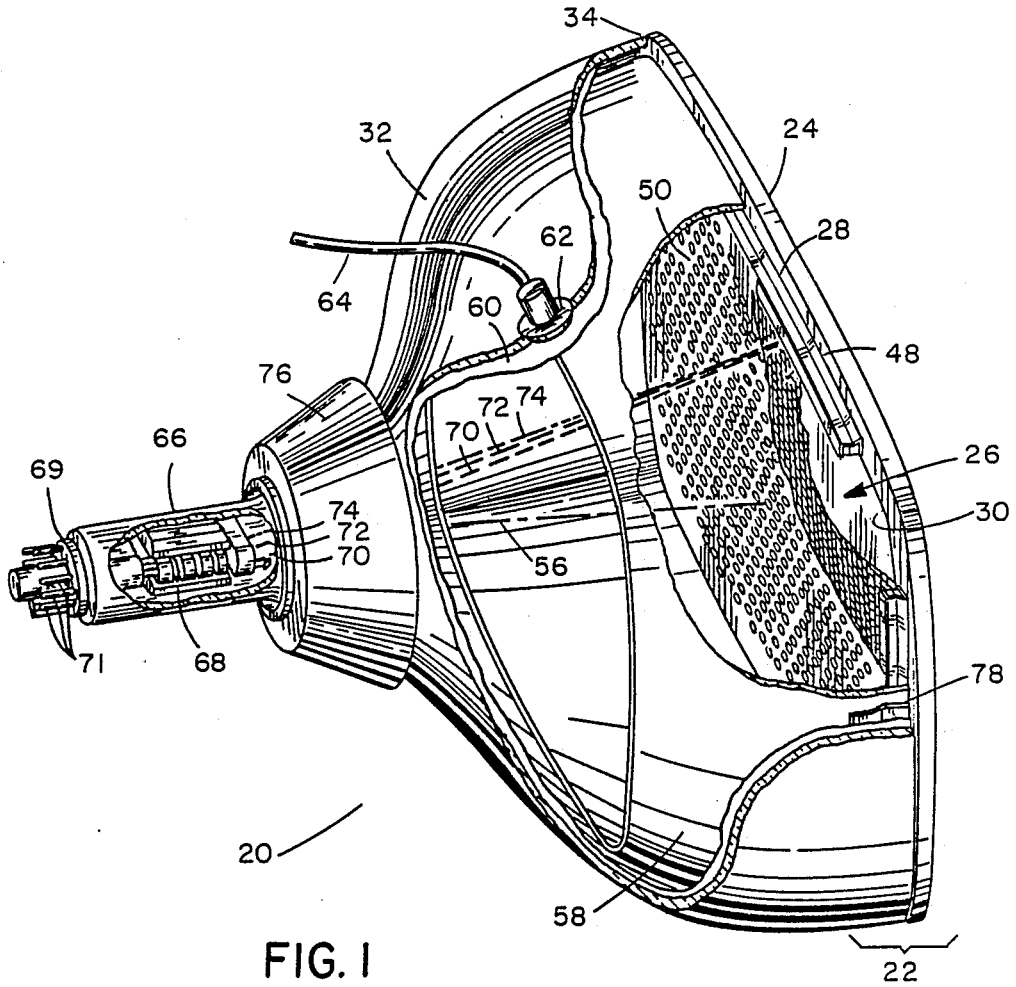
FIG. 1 is a side view in perspective of a color cathode ray tube having an improved shadow mask support structure according to the invention, with cut-away sections that indicate the location and relation of the structure to other major tube components.

A cathode ray tube having a faceplate assembly an improved structure according to the invention for supporting a tensed foil shadow mask is depicted in FIG. 1. The tube and its component parts are identified in FIGS. 1, 2 and 3, and described in the following paragraphs in this sequence: reference number, a reference name, and a brief description of structure, interconnections, relationship, functions, operation, and/or result, as appropriate.

20 color cathode ray tube
22 faceplate assembly
24 glass faceplate
26 inner surface of faceplate
28 centrally disposed phosphor screen
30 film of aluminum
32 funnel
34 peripheral sealing area of faceplate 24, adapted to mate with the peripheral sealing area of funnel 32
48 frame-like shadow mask support structure according to the invention located on opposed sides of the screen 28 for receiving and securing a tensed foil shadow mask; the support structure is depicted by way of example as comprising a unitary structure
50 metal foil shadow mask; after being tensed, the mask is mounted on support structure 48 and secured thereto
52 shadow mask apertures, indicated as greatly enlarged in the inset for illustrative purposes
56 anterior-posterior axis of tube
58 internal magnetic shield
60 internal conductive coating on funnel
62 anode button
64 high-voltage conductor
66 neck of tube
68 in-line electron gun providing three discrete in-line electron beams 70, 72 and 74 for exciting the respective red-light-emitting, green-light-emitting, and blue-light-emitting phosphor deposits on screen 28
69 base of tube
71 metal pins for conducting operating voltages, and sweep and video signals, through base 69 to electron gun 68
76 yoke which provides for the traverse of beams 70, 72 and 74 across screen 28

78 contact spring which provides an electrical path between the funnel coating 60 and the mask support structure 48.

Figure 2:
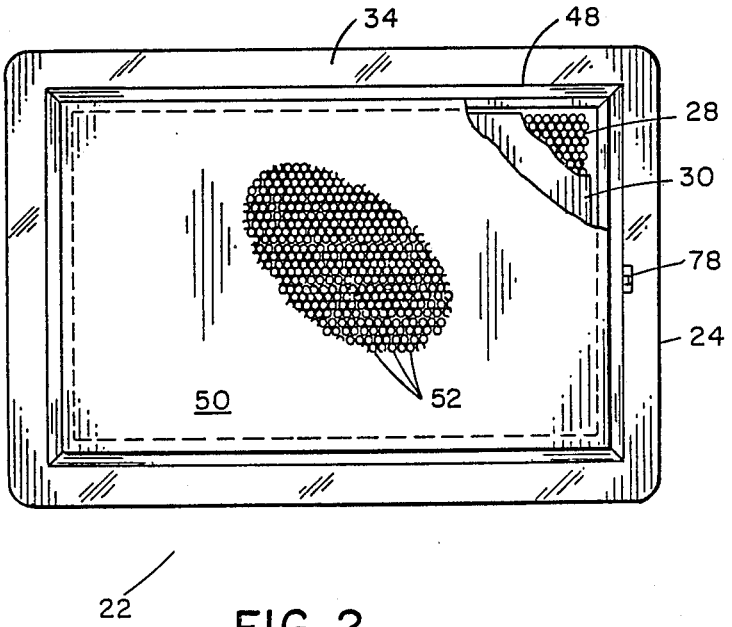
FIG. 2 is a plan view of the front assembly of the tube shown by FIG. 1, with parts cut away to show the relationship of the embodiment of the mask support structure shown by FIG. 1 with the faceplate and the shadow mask; an inset depicts mask apertures greatly enlarged.
Figure 3:
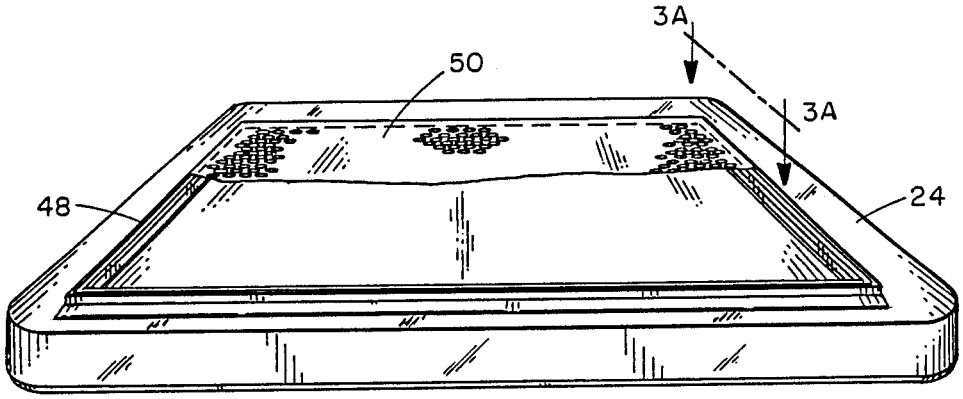
FIG. 3 is a view in perspective of the faceplate depicted in FIGS. 1 and 2, and showing in greater detail the location and orientation of a shadow mask support structure according to the invention as secured to a faceplate.
Figure 3A:
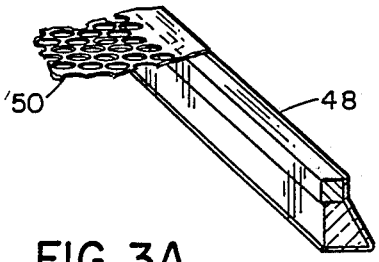
FIG. 3A is an enlarged view of a section of the shadow mask support structure depicted in FIG. 3.

As indicated by FIGS. 1 and 2, a faceplate assembly 22 for a cathode ray tube 20 includes a glass faceplate 24 having on its inner surface 26 a centrally disposed phosphor screen 28. A foil shadow mask 50 is mounted in tension on a preferred embodiment of frame-like shadow mask support structure 48 located on opposed sides of screen 28, and is secured to the inner surface 26. A faceplate 24 without the shadow mask, but with the preferred embodiment of mask support structure 48 secured to the inner surface 30, is depicted in FIG. 3. FIG. 3A provides an enlarged view of a section of the support structure 48 shown by FIG. 3.

Figure 4:
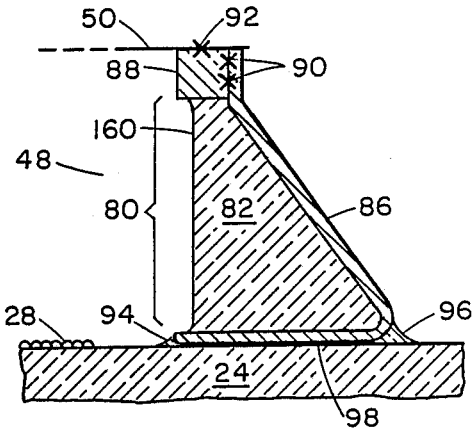
FIG. 4 is an enlarged cross-sectional view in elevation of the shadow mask support structure depicted in FIGS. 1–3.

With reference to FIG. 4, a preferred embodiment of a shadow mask support structure 48 according to the invention is shown. Support structure 48 according to the invention is depicted as having a generally L-shaped cross-section defining an open side 80, indicated by the bracket, facing the screen 28. Open side 80 is indicated as being filled with a reinforcing material 82 effective to render structure 48 mechanically rigid and prevent flexure of structure 48 toward screen 24 under the tension of the shadow mask 50.

Figure 4A:
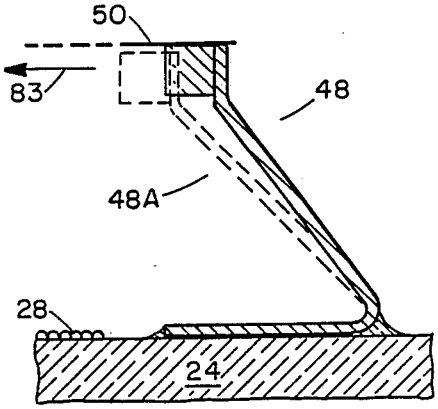
FIG. 4A is a view similar to FIG. 4 but indicating diagrammatically the effect of the tension of a shadow mask on a shadow mask support structure.

The potential for an undesired inward flexure of structure 48 is indicated schematically by FIG. 4A. Arrow 83 indicates the inward pull toward the screen 28 of the shadow mask 50 on the support structure 48; the magnitude of the pull is about 30 pounds per linear inch. The dashed line configuration 48A indicates diagrammatically the flexing of structure 48 toward the screen 28 under mask tension when the structure 48 is without the mechanical rigidity provided by the reinforcing material according to the invention. A mechanically rigid structure is mandatory because a movement of the shadow mask of as little as 0.0002 inch toward the screen 28 can result in misregistry of the mask apertures with the associated phosphor deposits, with consequent color impurities. The supportive effect of the reinforcing material such as a devitrified solder glass paste provides for a mechanically rigid shadow mask support structure. Support structure 48 will be noted as having a relatively thin section 86 secured to faceplate 24, and a relatively thick section 88 at its opposite end for receiving and securing shadow mask 50. Thick section 88 is indicated symbolically as being attached to thin section 86 as by resistance welding, for example, as shown by weldment symbols 90. Shadow mask 50 may also be secured to thick section 88 by weldments 92, which are preferably laser weldments according to the laser welding means and process fully described and claimed in referent copending application Ser. No. 058,059 of common ownership herewith. The reinforcing material 82 preferably comprises a devitrified solder glass which may comprise, by way of example, solder glass CV-810 supplied by Owens-Illinois Television Products Division of Toledo, Ohio. A solder glass product supplied by another manufacturer may as well be used provided that it has the same properties and characteristics.

The material comprising the relatively thin section 86 and the relatively thick section 88 preferably comprises a metal such as Alloy No. 27 manufactured by Carpenter Technology of Reading, Pa.; this material has a coefficient of thermal contraction of approximately 105 to $109\times10^{-7}$ in/in/degree C. over the range of the temperatures required for devitrification—from ambient temperature to 435 degrees C. The glass of the faceplate 24 in turn has a CTC of approximately $103\times10^{-7}$/degree C. over the designated range. The use of relatively thin section according to the invention, such as section 86, offers three benefits: (1) it provides a substantial saving in the costs of the alloy; (2) it is much lighter than an equivalent solid section of the metal; and (3), being thin, the stress on the glass of the faceplate resulting from its contraction is less than if the support structure were a solid bar of metal. The relatively thick section 88 provides for an adequate metal foundation for receiving and securing the mask 50.

The raw material comprising Alloy No. 27 is first sand-blasted. It is then rolled into flat form blanks and fired in wet hydrogen at a temperature of 880 degrees C. for one hour, following which it is formed into the desired configurations according to the invention. By way of example, the height of a typical mask support structure is about 0.3 inch, and the end that is contiguous to the glass of the faceplate is about 0.220 inch. The end which receives the shadow mask is preferably at least 0.050 inch in breadth to provide an adequate surface for receiving and securing the mask.

The support structure 48 is preferably attached to the faceplate 24 by the same solder glass 82 that is used for filling the open side 80. The securement is indicated by fillets 94 and 96 of devitrified solder glass. It is also considered necessary to provide a thin layer 98 of solder glass between the faceplate 24 and the base of the support structure 48.

Figure 5:
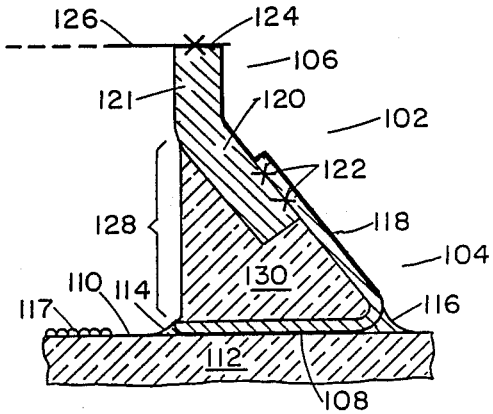
FIG. 5 is an enlarged cross-sectional view in elevation depicting another embodiment of a foil shadow mask support structure according to the invention.

Another embodiment of the support structure according to the invention is depicted in FIG. 5. Like support structure 48 shown by FIG. 4, support structure 102 comprises a relatively thin first member 104 and a relatively thick second member 106. Each member 102 and 104 will be noted as having a generally V-shape in cross-section. One leg of relatively thin member 102, leg 108, is shown as being secured to the inner surface 110 of faceplate 112 by fillets 114 and 116 of solder glass, noted as being devitrified. A phosphor screen 117 is indicated as having been deposited on the inner surface 110 of faceplate 112. The second leg 118 of relatively thin first member 104 is shown as extending upwardly, and being attached to a first leg 120 of relatively thick second member 106. The means of attachment may be by resistance welding, as indicated by the weldment symbols 122. A second leg 121 of relatively thick second member 106 is indicated as being normal to inner surface 110 of faceplate 112. Second leg 121 of relatively thick second member 106 is also depicted as having a surface 124 plano-parallel to inner surface 110 of faceplate 112 for receiving a securing a foil shadow mask 126 by means such as laser welding, as has been described.

The recess in first member 104 formed by the V-shape of first member 104, defines the open side 128 (indicated by the bracket) of support structure 102 for receiving a reinforcing material 130, indicated symbolically as being glass. The reinforcing material 130 is effective, according to the invention, to render structure 102 mechanically rigid, preventing flexure of the support structure 102 toward screen 117 under the tension of the shadow mask 126.

Figure 6:
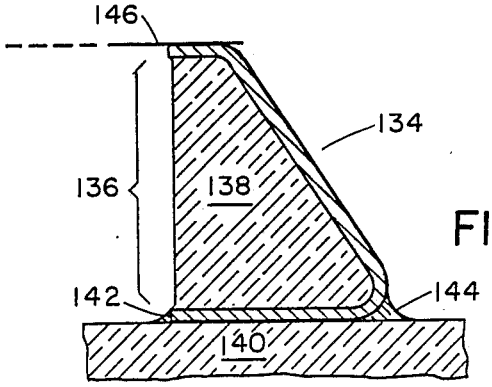
FIG. 6 is a cross-sectional view of yet another embodiment of a foil shadow mask support structure according to the invention.

Another embodiment of the invention is depicted by FIG. 6, in which a support structure 134 is indicated as being a unitary structure having a generally U-shaped cross-section defining an open side 136 (indicated by the bracket) for receiving a reinforcing material 138, indicated symbolically as being glass. As with the embodiments depicted in FIGS. 4 and 5, and described in the associated text, support structure 134 is shown as being attached to a faceplate 140 by fillets 142 and 144 of cement, preferably a devitrified solder glass, and has secured to it by weldments a foil shadow mask 146 under tension. The support structure 134 depicted by FIG. 6 preferably comprises an alloy 0.024 inch thick. The benefit of this configuration lies in the fact that no welding of dissimilar sections is required; also, it can be rolled relatively easily into U-shaped cross section shown, and once rolled, it is ready to be filled with a reinforcing material according to the invention.

In essence, a support structure according to the invention comprises an open-sided channel member filled with a reinforcing material for mechanical rigidity, one side of which is secured to the inner surface of a faceplate, and a second side on the reinforcing-material-filled open side supports a shadow mask. The structure is effectively lying on one side with the reinforcing-material-filled opening facing toward the center of the screen.

The support structure according to the invention may comprise a unitary, frame-like structure as depicted in FIGS. 1, 2 and 3. Alternately, it may comprise a plurality of discrete sections enclosing the screen. By way of example, a structure of the latter type is similar to a unitary support structure except that the corners are not physically connected.

A process according to the invention for use in the manufacture of a color cathode ray tube having a substantially flat glass faceplate with a centrally disposed screen and a tensed foil shadow mask, essentially comprises the following:

providing a structure for enclosing the screen and receiving and securing a foil shadow mask;

forming the structure to have an open side along its length;

filling the open side with a reinforcing material;

providing a faceplate and securing the structure to the faceplate with the open side and the reinforcing material facing the screen;

securing a shadow mask in tension on the structure;

whereby the reinforcing material is effective to render the structure mechanically rigid and prevent flexure of the structure toward the screen under the tension of the shadow mask.

A complete process according to the invention using devitrifying solder glass as the reinforcing material comprises the following:

providing an elongated shadow mask support structure having a top surface and a bottom surface;

providing an open side along the length of the support structure;

filling the open side with a devitrifying solder glass paste;

heating the support structure to devitrify the solder glass and secure the solder glass in the open side;

providing a faceplate having a centrally disposed screening area;

applying a paste of devitrifying solder glass to the bottom surface of the structure;

enclosing the screening area within the support structure, and placing the structure in contact with the inner surface, with the open side facing the screening area;

heating the faceplate and the structure to devitrify the solder glass and secure the structure to the faceplate;

securing a foil shadow mask in tension to the support structure;

using the shadow mask as a registered stencil, photoscreening phosphor deposits on the screening area to form a screen;

whereby the compressive strength of the devitrified solder glass is effective to render the structure mechanically rigid and prevent flexure of the structure toward the screen under the tension of the shadow mask.

Figure 7:
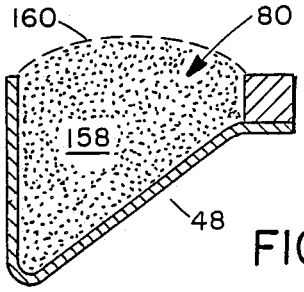
FIG. 7 is a cross-sectional view of a support structure according to the invention depicting details of the process for dispensing a solder glass paste into the open side of the structure.

With reference to FIG. 7, the filling of a support structure 48, described in connection with FIG. 4, is indicated. Structure 48 is shown as filled with solder glass paste 158, depicted by the stipple pattern. The paste can be dispensed with a solder glass paste dispenser well known in the art. It will be noted that the open end 80 of support structure 48 is over-filled with the paste 158, with the amount of over-filling indicated by the dashed line 160. This over-filling is necessary because, upon heating and devitrification, the volume of the solder glass paste shrinks about 36 percent. As a result, the final level line is approximately that indicated by the solid line 160 in FIG. 4. Similar final level lines will be noted in the configurations of the support structures depicted in FIGS. 5 and 6. A benefit of the configurations according to the invention, with their large open sides for receiving the solder glass paste, is that there is no possibility of air pockets forming in the fill area. As has been noted, such pockets can be the cause of gassy tubes.

Following the solder glass paste dispensing step, the support structure is inserted in an oven where it is heated to a maximum temperature of 440 degrees C. for a period of 35 to 45 minutes. The temperature and time duration cited is adequate to shrink the solder glass paste to the final level line, and devitrify the solder glass. A similar heating process is followed in the attachment of the support structure to the faceplate. In the final sealing process, in which the faceplate is sealed to the funnel—also by means of a devitrifying solder glass paste—a lehr is used, and the duration of heating is more on the order of four to five hours. It is to be noted that the solder glass in the open end of the support structure is unaffected by the heat engendered in the final sealing process as it has already been devitrified.

A thorough "wetting" of the metal of the support structure by the solder glass results from the process as described; that is, by depositing a solder glass paste having good wetting properties in the open sides of the embodiments of the support structures according to the invention. Thorough wetting is essential to the positive adherence of the devitrified solder glass in the open sides.

Figure 8:
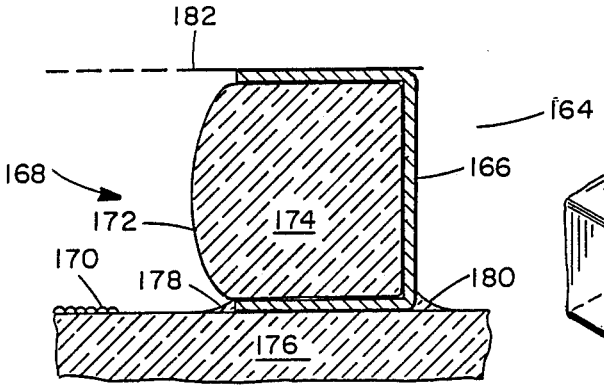
FIG. 8 is a cross-sectional view of a further embodiment of a foil shadow mask support structure according to the invention.

While a particular embodiment of the invention has been shown and described, it will be readily apparent to those skilled in the art that changes and modifications may be made in the inventive means and process without departing from the invention in its broader aspects. For example, the shadow mask support structure 164 depicted in FIG. 8 provides the benefits of the invention. Support structure 164 is indicated as comprising a U-Shaped cross-section 166, depicted schematically as comprising a metal, and which defines an open side 168 facing a screen 170. The metal may comprise the aforedescribed Carpenter Alloy No. 27. Open side 168 according to the invention is filled with a reinforcing material 172, shown symbolically as being glass.

Reinforcing material 172 preferably comprises a preformed glass member 174 captivated in open side 168.

Figure 8A:
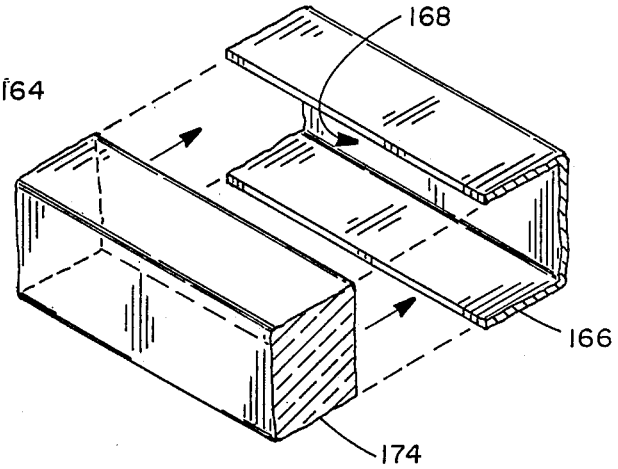
FIG. 8A is an exploded view in perspective showing details of the assembly of the support structure depicted in FIG. 8.

With reference to FIG. 8A, glass member 174 is shown as being rectangular in cross-section prior to its installation. As indicated by the associated arrows, glass member 174 is inserted into the open side 168 of support structure 164. It is noted that glass member 174 is sized so that it can be inserted easily into the open side.

The support structure 164 with the glass member 174 installed is then subjected to a temperature in the range of 800 degrees C. to 1,000 degrees C. for about five minutes, causing the glass member 174 and the metal of the structure to bond permanently together. Upon heating, glass member 174 assumes the rounded contour on the open side 168 of the support structure 164, as indicated in FIG. 8.

Support structure 164 is indicated as being secured to a faceplate 176 by fillets 178 and 180, which preferably comprise devitrified solder glass. Reinforcing material 174 is effective to render support structure 164 mechanically rigid, preventing flexure of structure 164 toward screen 170 under the tension of the shadow mask 182.

The aim of the appended claims is to cover all changes and modifications as fall within the true spirit and scope of the invention.

What is claimed is:

1. A faceplate assembly for a color cathode ray tube including a glass faceplate having on its inner surface a centrally disposed phosphor screen, a metal foil shadow mask mounted in tension on a mask-support structure located on opposed sides of said screen, and means for securing the mask-support structure to said inner surface, said support structure having an open side facing said screen filled with a reinforcing material effective to render said structure mechanically rigid and prevent fixture of said structure toward said screen under the tension of said shadow mask.

2. The faceplate assembly according to claim 1 wherein said reinforcing material comprises devitrified solder glass.

3. The faceplate assembly according to claim 1 wherein said reinforcing material comprises a preformed glass member captivated in said open side.

4. The faceplate assembly according to claim 1 wherein said support structure has a generally L-shaped cross-section defining said open side.

5. The faceplate assembly according to claim 4 wherein said said structure includes a relatively thin section secured to said faceplate, and a relatively thick section at its opposite end for receiving and securing said shadow mask.

6. The faceplate assembly according to claim 1 wherein said support structure has a generally U-shaped cross-section defining said open side.

7. The faceplate assembly according to claim 1 wherein said support structure comprises a relatively thin first member and a relatively thick second member, with each member have a generally V-shape in cross-section, with one leg of said first member secured to said inner surface, and the second leg extending upwardly at an acute angle and attached to a first leg of said second member, with the second leg of said second member normal to said inner surface, said second leg of said second member having a surface plano-parallel to said inner surface for receiving and securing said mask, the recess of said first member formed by said V-shape defining said open side of said structure for receiving said reinforcing material.

8. The faceplate assembly according to claim 1 wherein said support structure comprises a unitary, frame-like structure.

9. The faceplate assembly according to claim 1 wherein said support structure comprises a plurality of discrete sections enclosing said screen.

10. A faceplate assembly for a color cathode ray tube including a glass faceplate having on its inner surface a centrally disposed phosphor screen, and means for securing the mask-support structure to said inner surface, said support structure comprising an open-sided channel member filled with a reinforcing material for mechanical rigidity, one side of said structure being secured to said inner surface, and a second side on the reinforcing-material-filled open side supporting said shadow mask, said structure effectively lying on one side with the reinforcing-material-filled opening facing toward the center of said screen.

11. The faceplate assemble according to claim 10 wherein said reinforcing material comprises a preformed glass member captivated in said open side.

12. The faceplate assemble according to claim 10 wherein said reinforcing material comprises a devitrified solder glass.

13. For use in the manufacture of a color cathode ray tube having a substantially flat glass faceplate with a centrally disposed screen and a tensed foil shadow mask, a process comprising:

providing a structure for enclosing said screen and receiving and securing a foil shadow mask;

forming said structure to have an open side along its length;

filling said open side with a reinforcing material;

providing a faceplate and securing said structure to said faceplate with said open side and the reinforcing material facing said screen;

securing a shadow mask in tension on said structure;

whereby the reinforcing material is effective to render the structure mechanically rigid and prevent flexure of the structure toward the screen under the tension of the shadow mask.

14. For use in the manufacture of a color cathode ray tube having a substantially flat glass faceplate and a tensed foil shadow mask, a process comprising:

providing a shadow mask support structure having an open side along its length;

filling said open side with a reinforcing material;

providing a faceplate having a centrally disposed screening area;

enclosing said screening area within said support structure, with said open side and the reinforcing material facing said screening area;

securing said support structure to said faceplate;

securing a foil shadow mask in tension to said structure;

using said mask as a stencil, photoscreening phosphor deposits on said screening area;

whereby the reinforcing material is effective to render the structure mechanically rigid and prevent flexure of the structure toward the screen under the tension of the shadow mask.

15. For use in the manufacture of a front assembly for a color cathode ray tube having a substantially flat glass faceplate and a tensed foil shadow mask, a process comprising:

providing an elongated shadow mask support structure having a top surface and a bottom surface;

providing an open side along the length of said support structure;

filling said open side with a devitrifying solder glass paste;

heating said support structure to devitrify said solder glass and secure said glass in said open side;

providing a faceplate having a centrally disposed phosphor screening area;

applying a paste of devitrifying solder glass to said bottom surface of said structure;

enclosing said screening area within said support structure, and placing said structure in contact with said inner surface, with said open side facing said screening area;

heating said faceplate and said structure to devitrify said solder glass and secure said structure to said faceplate;

securing a foil shadow mask in tension to said support structure;

using said mask as a registered stencil, photoscreening phosphor on said screening area to form a phosphor screen;

whereby the compressive strength of the devitrified solder glass is effective to render the structure mechanically rigid and prevent flexure of the structure toward the screen under the tension of the shadow mask.

16. For use in the manufacture of a front assembly for a color cathode ray tube having a substantially flat glass faceplate and a tensed foil shadow mask, a process comprising:

providing an elongated shadow mask support structure having a top surface and a bottom surface;

providing an open side along the length of said support structure;

inserting a preformed glass member in said open side;

heating said support structure to a temperature effective to bond said support structure and said preformed glass member permanently together;

providing a faceplate having a centrally disposed phosphor screening area;

applying a paste of devitrifying solder glass to said bottom surface of said structure;

enclosing said screening area within said support structure, and placing said structure in contact with said inner surface, with said open side facing said screening area;

heating said faceplate and said structure to devitrify said solder glass and secure said structure to said faceplate;

securing a foil shadow mask in tension to said support structure;

using said mask as a registered stencil, photoscreening phosphor deposits on said screening area to form a phosphor screen;

whereby the compressive strength of the devitrified solder glass is effective to render the structure mechanically rigid and prevent flexure of the structure toward the screen under the tension of the shadow mask.

* * * * *